US009620879B2

(12) United States Patent
Li

(10) Patent No.: US 9,620,879 B2
(45) Date of Patent: Apr. 11, 2017

(54) ELECTRICAL TERMINAL

(71) Applicant: MOLEX INCORPORATED, Lisle, IL (US)

(72) Inventor: Guo-Li Li, Shanghai (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/110,982

(22) PCT Filed: Jan. 26, 2015

(86) PCT No.: PCT/US2015/012872
§ 371 (c)(1),
(2) Date: Jul. 12, 2016

(87) PCT Pub. No.: WO2015/112963
PCT Pub. Date: Jul. 30, 2015

(65) Prior Publication Data

US 2016/0336669 A1 Nov. 17, 2016

(30) Foreign Application Priority Data

Jan. 26, 2014 (CN) ..... 2014 2 0051187 U

(51) Int. Cl.
*H01R 13/627* (2006.01)
*H01R 13/11* (2006.01)
(Continued)

(52) U.S. Cl.
CPC ..... *H01R 13/114* (2013.01); *H01R 4/185* (2013.01); *H01R 13/432* (2013.01); *H01R 13/6273* (2013.01); *H01R 13/6272* (2013.01)

(58) Field of Classification Search
CPC H01R 13/114; H01R 13/432; H01R 13/6272; H01R 13/6273; H01R 4/185
(Continued)

(56) References Cited

U.S. PATENT DOCUMENTS 5,556,291 A 9/1996 Ito
6,280,206 B1 8/2001 Kuroda et al.
(Continued)

FOREIGN PATENT DOCUMENTS

JP 2009-117379 A 5/2009
KR 2010-0013632 A 2/2010
(Continued)

*Primary Examiner* — Khiem Nguyen
(74) *Attorney, Agent, or Firm* — Clarence R. Moon

(57) ABSTRACT

A terminal comprises a base portion, a mating portion, an engaging portion and a fixed portion. The mating portion consists of a pair of elastic arms, the pair of elastic arms extend forwardly from the base portion in symmetry with each other and cooperatively define an insertion space, and the pair of elastic arms each have a side wall and two protrusions protruding toward the insertion space, the two side walls are opposite to each other and spaced apart from each other and each are formed with a buffer section close to an end edge and an extension section between the buffer section and the base portion, the two side walls each make a height of the buffer section lower than a height of the extension section, the protrusions of the each elastic arm are formed on the side wall and arranged along a front to rear direction and spaced apart from each other, the protrusion at the front is at least partially positioned in the buffer section and has a larger size than the protrusion at the rear. The engaging portion extends rearwardly from the base portion. The fixed portion protrudes from the base portion.

20 Claims, 7 Drawing Sheets

(51) Int. Cl.
*H01R 4/18* (2006.01)
*H01R 13/432* (2006.01)

(58) Field of Classification Search
USPC ..... 439/350, 355, 856, 857, 862
See application file for complete search history.

(56) References Cited

U.S. PATENT DOCUMENTS

| | | | |
|---|---|---|---|
| 6,547,608 | B2 | 4/2003 | Sato et al. |
| 2002/0151215 | A1 | 10/2002 | Yamanashi et al. |
| 2006/0128192 | A1 | 6/2006 | Wang |
| 2007/0049111 | A1 | 3/2007 | Muller et al. |
| 2009/0130902 | A1 | 5/2009 | Hall et al. |
| 2009/0227132 | A1 | 9/2009 | Bethurum et al. |
| 2011/0053406 | A1 | 3/2011 | Lin |
| 2011/0287655 | A1 | 11/2011 | Lin |
| 2012/0238124 | A1 | 9/2012 | Zhao |
| 2013/0102180 | A1 | 4/2013 | Muro |

FOREIGN PATENT DOCUMENTS

| | | | |
|---|---|---|---|
| KR | 10-1224724 | B1 | 1/2013 |
| TW | M379880 | U1 | 5/2012 |

ELECTRICAL TERMINAL

RELATED APPLICATIONS

This application claims priority to Chinese Application No. 201420051187.3, filed Jan. 26, 2014, which is incorporated herein by reference in its entirety.

FIELD OF THE INVENTION

The present disclosure relates to a terminal, and particularly relates to a terminal of electrical connector.

DESCRIPTION OF RELATED ART

Taiwanese patent No TWM379880U1 discloses an electrical connection terminal, which comprises a receiving portion with a mating opening, the receiving portion has side walls capable of being elastically displaced and protrusions formed on the side walls and protruding into the receiving portion, the protrusion away from the mating opening further protrudes into the receiving portion than the protrusion close to the mating opening, so as to assure a certain mating force and contact reliability.

However, because the mating opening is surrounded by the receiving portion along a periphery thereof, a thickness of the side walls of the receiving portion makes an entrance space of the mating opening narrow, only more precise alignment is performed on a mating terminal, can the mating terminal be inserted, and although the receiving portion can provide a sufficient positive force, because it is not easy to push the side walls of the receiving portion open, only a larger insertion force is applied on the mating terminal, can the mating terminal be inserted into the receiving portion.

BRIEF SUMMARY

Therefore, an object of the present disclosure is to provide a terminal for easy insertion of a mating terminal and capable of maintaining stable contact with the mating terminal.

Accordingly, the present disclosure provides a terminal comprising a base portion, a mating portion, an engaging portion and a fixed portion. The mating portion consists of a pair of elastic arms, the pair of elastic arms extend forwardly from the base portion in symmetry with each other and cooperatively define an insertion space, and the pair of elastic arms each have a side wall and two protrusions protruding toward the insertion space, the two side walls are opposite to each other and spaced apart from each other and each are formed with a buffer section close to an end edge and an extension section between the buffer section and the base portion, the two side walls each make a height of the buffer section lower than a height of the extension section, the protrusions of the each elastic arm are formed on the side wall and arranged along a front to rear direction and spaced apart from each other, the protrusion at the front is at least partially positioned in the buffer section and has a larger size than the protrusion at the rear. The engaging portion extends rearwardly from the base portion. The fixed portion protrudes from the base portion.

In an embodiment, the protrusion at the front further protrudes toward the insertion space than the protrusion at the rear.

In an embodiment, the each elastic arm further has a strengthening rib formed on the extension section of the side wall and the strengthening rib is positioned behind the two protrusions and extends along the front to rear direction.

In an embodiment, the side wall of the each elastic arm makes the height of the buffer section gradually increases the end edge to the extension section so as to form a slope.

In an embodiment, the each elastic arm further has a bottom wall perpendicularly connected with the side wall, and a gap extending rearwardly from the end edge is formed between the bottom walls of the pair of elastic arms.

In an embodiment, a penetrating groove extending along the front to rear direction is formed between the side wall and the bottom wall of the each elastic arm.

In an embodiment, the fixed portion is an elastic tab extends rearwardly and obliquely downwardly from the base portion.

In an embodiment, the engaging portion is used to engage an electrical conductive wire.

The effects of the present disclosure are as follows: due to the mating portion of the terminal having dual elastic arms, it is easy to push the two elastic arms open, which reduces the force applied for insertion of the mating terminal, and the side walls of the each elastic arm making the height of the buffer section lower than the height of the extension section, the insertion port has a larger insertion space, so that the mating portion of the mating terminal is easily inserted into the insertion port. When the mating portion of the mating terminal is inserted between the two elastic arms, the protrusion at the front is at least partially positioned in the buffer section, the protrusion at the front contacts the mating portion of the mating terminal first, because the protrusion at the front has a larger size and the protrusion at the front further protrudes toward the insertion space than the protrusion at the rear, allowing both the protrusion at the front and the protrusion at the rear to contact the mating portion of the mating terminal, increasing the number of contact points between the two terminals and assuring stability of the electrical connection. Additionally, the elastic arm is strengthened by the strengthening rib allowing the elastic arm to generate a larger positive force and further increasing the stability of the electrical connection.

BRIEF DESCRIPTION OF THE DRAWINGS

The other features and effects of the present disclosure will be apparent through embodiments with reference to the Figures, and in which.

DETAILED DESCRIPTION

Figure 1:
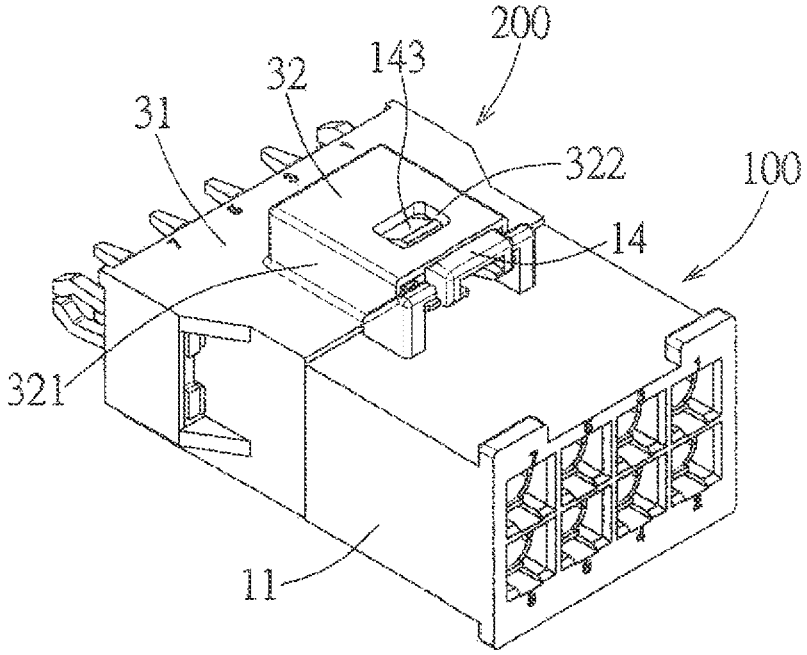
FIG. 1 is a perspective view illustrating a mating state of a first electrical connector and a second electrical connector of an embodiment of the present disclosure.
Figure 2:
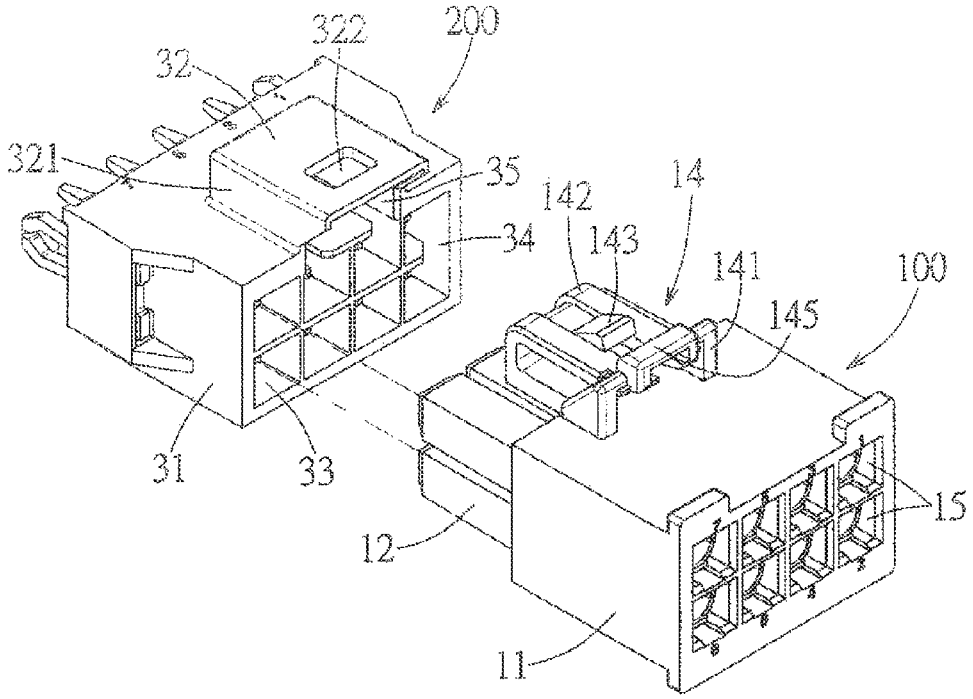
FIG. 2 is an exploded perspective view illustrating a mating relationship of the first electrical connector and the second electrical connector of the embodiment.
Figure 3:
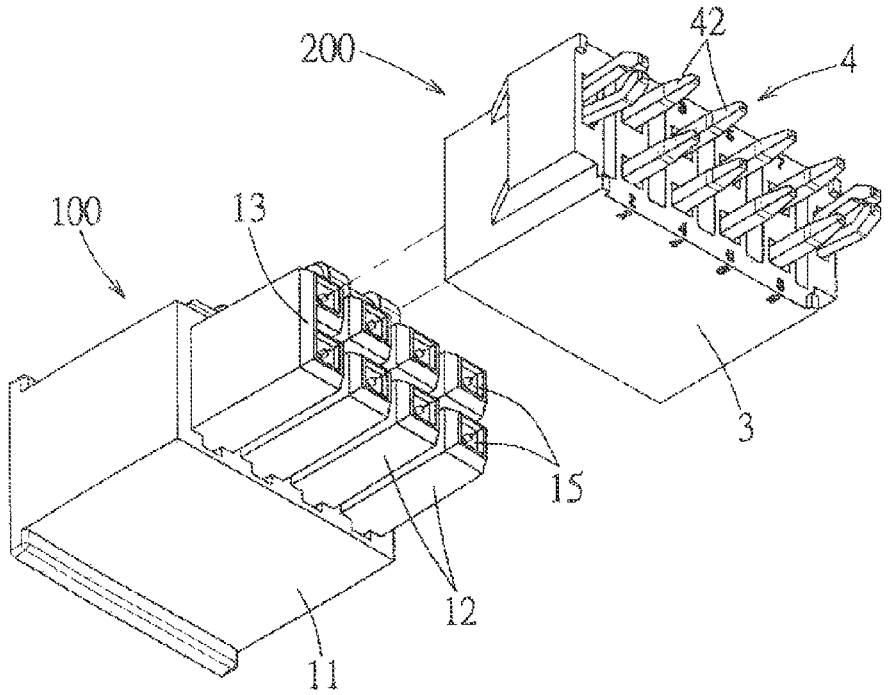
FIG. 3 is a view of FIG. 2 viewed from another angle.

Referring to FIG. 1 through FIG. 3, an embodiment of the disclosure will be described and by example, includes an electrical connection device comprising a first electrical connector 100 and a second electrical connector 200 which may be mated with each other.

Figure 4:
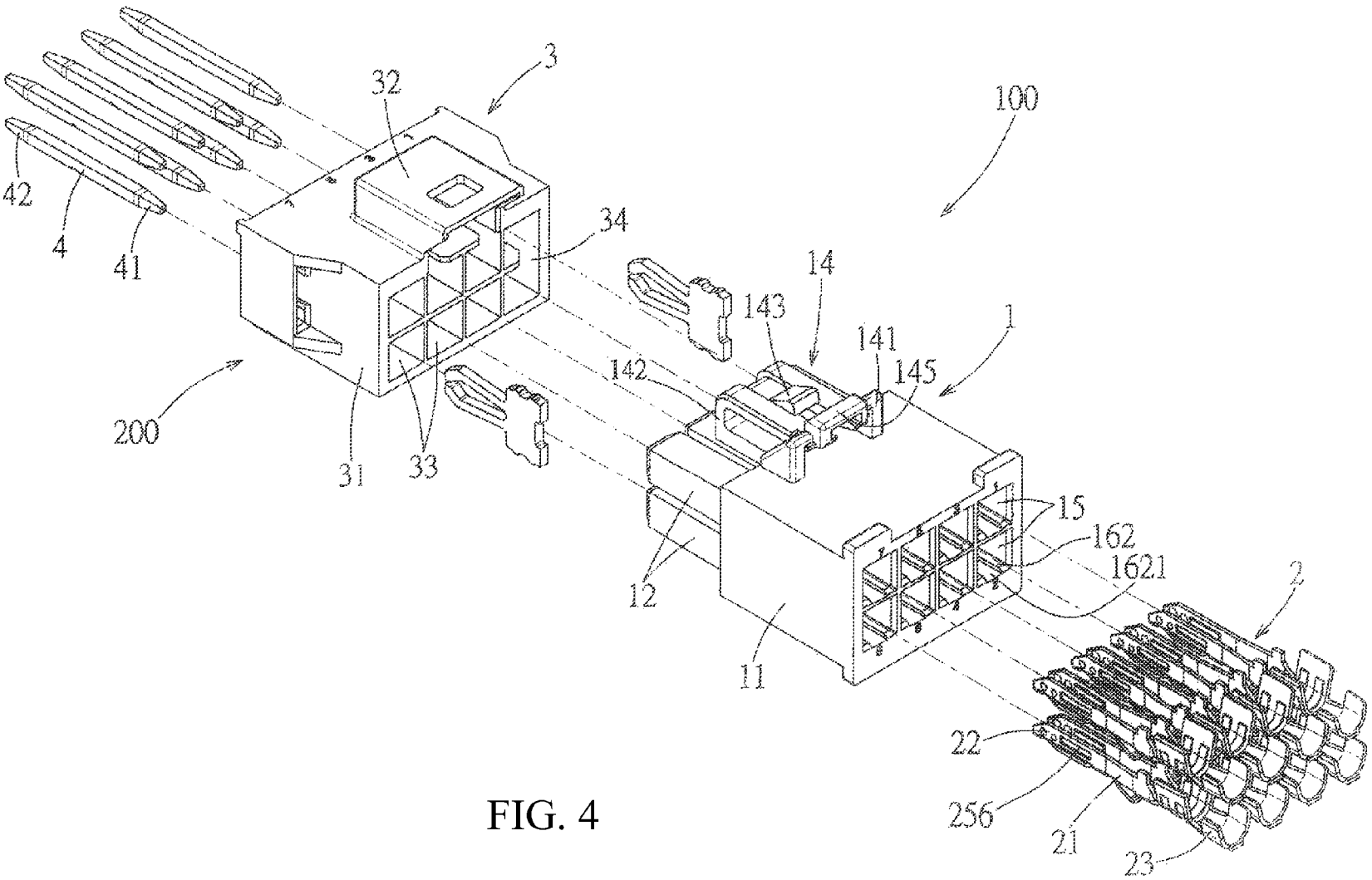
FIG. 4 is an exploded perspective view illustrating an assembly relationship of an insulative housing and terminals of the first electrical connector and an insulative housing and terminals of the second electrical connector of the embodiment.
Figure 5:
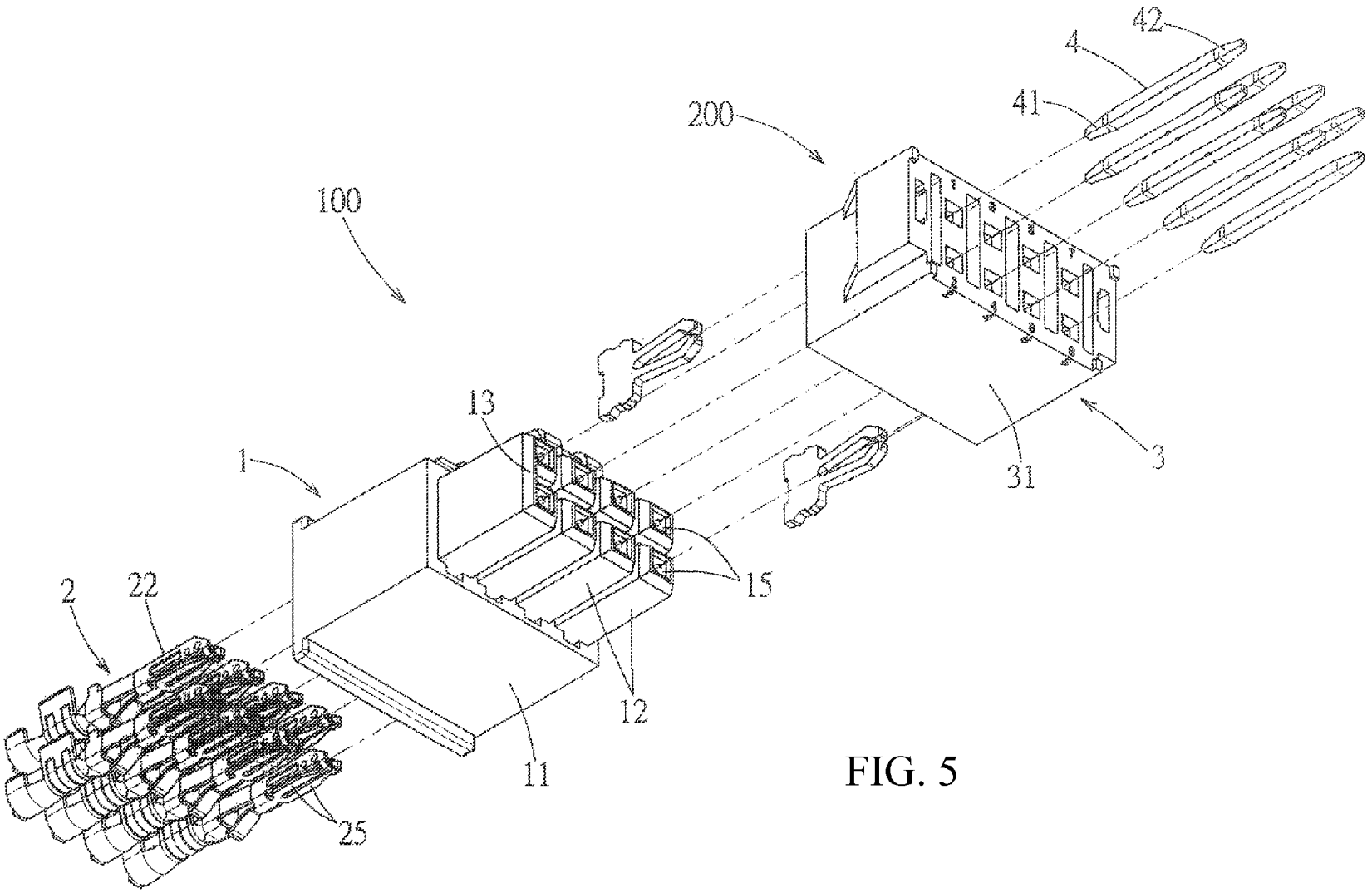
FIG. 5 is a view of FIG. 4 viewed from another angle.
Figure 6:
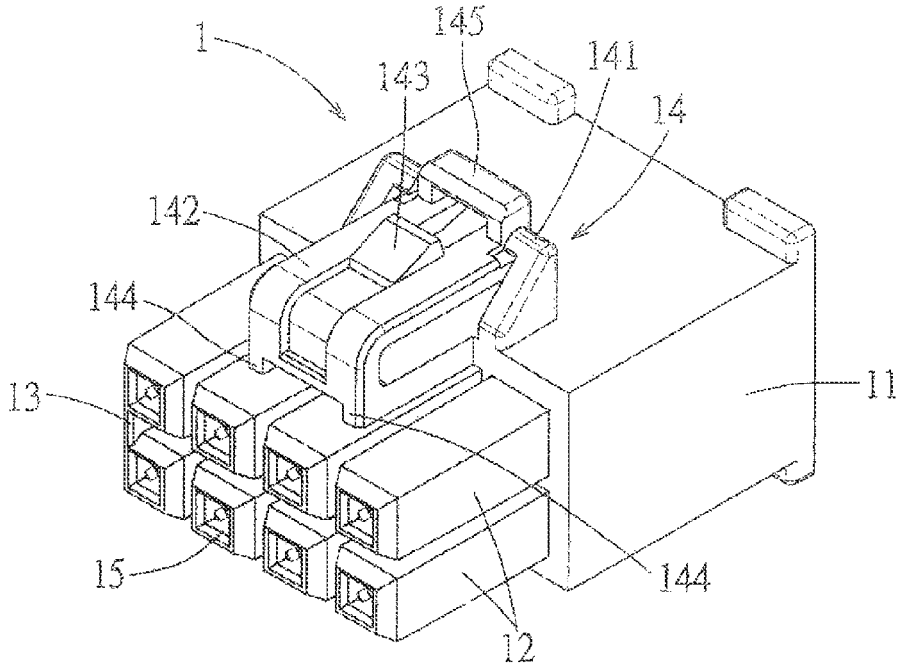
FIG. 6 is a perspective view illustrating the first electrical connector of the embodiment.
Figure 7:
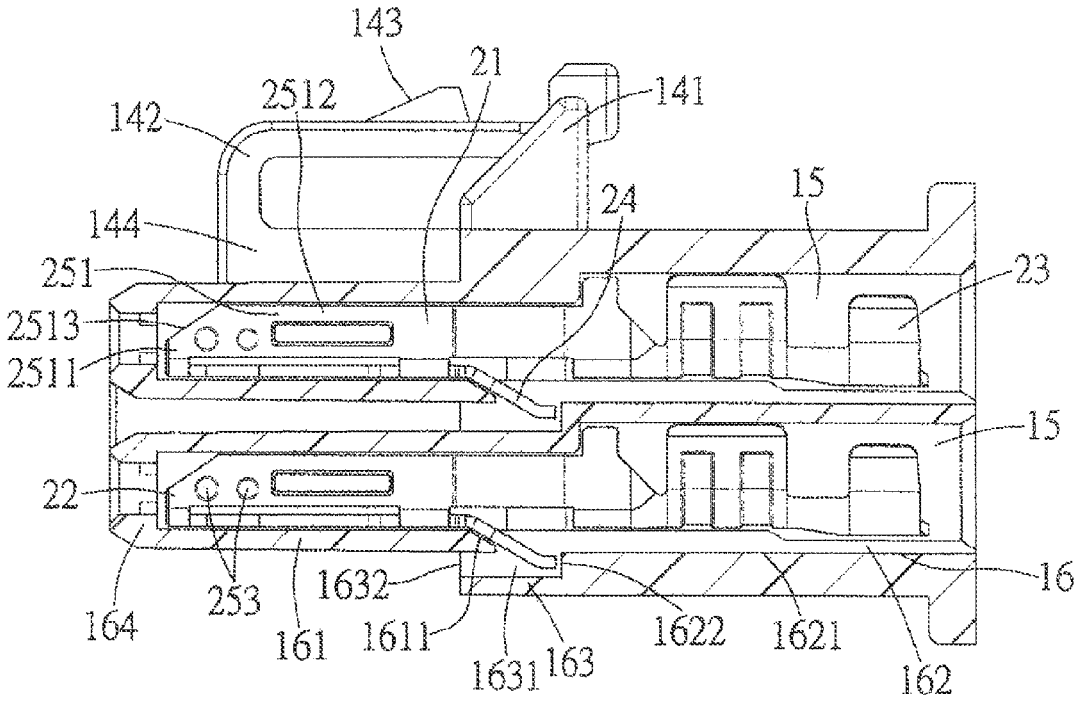
FIG. 7 is a partially cross sectional view illustrating an assembly relationship of the terminals and the insulative housing of the first electrical connector of the embodiment.

Referring to FIG. 4 through FIG. 6, the first electrical connector 100 comprises a first insulative housing 1 and a plurality of terminals 2.

The first institutive housing 1 has a first base block 11, a plurality of cylinders 12, a key 13 and a first latch unit 14. The plurality of cylinders 12 extend from the first base block 11 in an array arrangement, and the plurality of cylinders 12 and the first base block 11 cooperatively define a plurality of terminal receiving grooves 15 which respectively extend from the plurality of cylinders 12 to the first base block 11 and penetrate the plurality of cylinder 12 and the first base block 11 along a front to rear direction. The key 13 is connected between two adjacent cylinders 12 of the plurality of cylinders 12, in the embodiment, the key 13 is connected between two adjacent cylinders 12 which are positioned at the outside of the plurality of cylinders 12 and along an up and down direction, but not limited to this, as long as any two adjacent cylinders 12 are selected for the key 13. As such, both ends of the key 13 are respectively connected to the two cylinders 12 without an edge and corner of a free end.

The first latch unit 14 is connected to the first base block 11 and extends toward the same side along the direction of the plurality of cylinders 12. Specifically, the first latch unit 14 comprises a pair of limit portions 141 provided to a top surface of the first base block 11, a first body 142 provided to a top portion of the first base block 11, a latching block 143 provided on the first body 142, two engagement ribs 144 respectively connecting the first body 142 and the two cylinders 12 of the plurality of cylinders 12, and a press portion 145 is provided on the first body 142. The first body 142 extends from the first base block 11 toward a side where the plurality of cylinders 12 are present and then is bent and extends reversely above of the first base block 11 so as to form a free end, the latching block 143 is provided between a bent portion and the free end of the first body 142 and extends upwardly, the bent portion of the first body 142 and the plurality of cylinders 12 are positioned at the same side facing the second electrical connector 200. Both sides of the free end of the first body 142 are respectively limited by the pair of limit portions 141, preventing the first body 142 warping away from the first base block 11. The first body 142 is formed as a cantilever and elastically deforms, so that the latching block 143 has a space to elastically displace along the up and down direction. The two engagement ribs 144 respectively extend downwardly from a bottom side of the first body 142 and are connected to the two cylinders 12, which allow the bottom side of the first body 142 to be supported increasing the stability of the first body 142. The press portion 145 is positioned at the free end of the first body 142 and a force may be applied on the press portion 145 allowing the free end of the first body 142 to displace downwardly and at the same time the free end of the first body 142 moves the latching block 143 downwardly.

Figure 11:
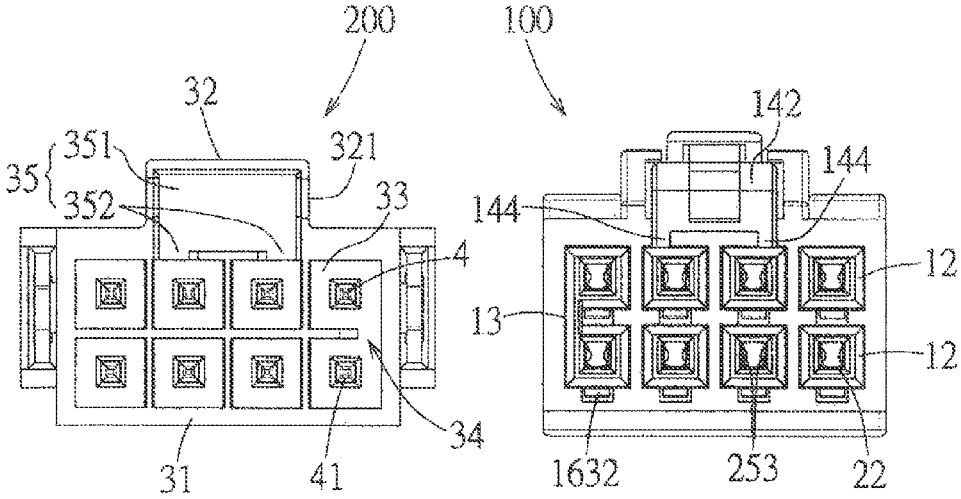
FIG. 11 is a side view illustrating a corresponding relationship of an improper insertion preventing structure of the first electrical connector and an improper insertion preventing structure of the second electrical connector of the embodiment.

Referring to FIG. 4 and FIG. 7 to FIG. 10, a bottom side of the each terminal receiving groove 15 is defined by a support wall 16. The support wall 16 has a front segment 161 close to the front, a rear segment 162 close to the rear, and a middle segment 163 between the front segment 161 and the rear segment 162. The rear segment 162 is formed with a recess portion 1621 extending along the front to rear direction, and is formed with a step 1622 at a location where the recess portion 1621 is adjacent to the middle segment 163, the recess portion 1621 is lower than the front segment 161, that is, a height of the step 1622 is lower than a height of the front segment 161. The middle segment 163 is formed with a recessed space 1631 between the front segment 161 and the step 1622, and the recessed space 1631 has an opening 1632 as shown in FIG. 11 which is lower than the front segment 161 and opens to the front.

The plurality of terminals 2 are respectively provided in the plurality of terminal receiving grooves 15, and each having a base portion 21 and a mating portion 22 extending forwardly from the base portion 21, an engaging portion 23 extending rearwardly from the base portion 21 for engaging with an electrical conductive wire (not shown), and a fixed portion 24 protruding from the base portion 21. The mating portion 22 and the engaging portion 23 are positioned respectively to two positions of the corresponding terminal receiving groove 15 which are respectively adjacent to the front segment 161 and the rear segment 162, and at least a part of the base portion 21 is positioned at a location of the corresponding terminal receiving groove 15 adjacent the front segment 161. A fixed portion 24 is formed as an elastic tab extending rearwardly and obliquely downwardly from the base portion 211 and extends obliquely downwardly into the recessed space 1631 from a rear end of the front segment 161 and a distal end of the fixed portion 24 faces the step 1622 so as to be stopped by the step 1622 and be prevented from moving rearwardly. Moreover, the rear end of the front segment 161 is formed with a supporting slope 1611 for abutting the corresponding elastic tab 24, which may position the elastic tab 24 at a preset oblique angle. The support wall 16 further has a front stopping portion 164 protruding from the front segment 161 close to a front end of the support wall 16 stopping the mating portion 22 of the corresponding terminal 2 from moving forwardly. As such, the terminal 2 is limited and fixed in the terminal receiving groove 15. When the terminal 2 is mounted, the terminal 2 is inserted into the terminal receiving groove 15 from the rear, the elastic tab 24 may be squeezed allowing the distal end of the elastic tab 24 to be elastically displaced toward the base portion 21, and the recess portion 1621 of the rear segment 162 of the support wall forming a passage the elastic tab 24, reducing a degree of elastic displacement of the elastic tab 24.

When the terminal 2 moves from the rear to the front and reaches a preset position, the elastic tab 24 abuts against the supporting slop 1611 and enters into recessed space 1631, at this time the force deforming the elastic tab 24 is released and the elastic tab 24 returns to its original state, the distal end of the elastic tab 24 immediately is lower than the recess portion 1621, when the terminal 2 moves rearwardly, the distal end of the elastic tab 24 will abut against the step 1622 so that the movement of the elastic tab 24 is limited. However, if the terminal 2 needs to be reset or the terminal 2 needs to be removed from the terminal receiving groove 15, a tool may be used to insert into the recessed space 1631 via the opening 1632 of the recessed space 1631 and in turn apply a force on the elastic tab 24. Due to the force applied, the elastic tab 24 can be elastically displaced upwardly beyond the step 1622 allowing the terminal 2 to be moved rearwardly and removed from the terminal receiving groove 15. Also, due to the recess portion 1621 being lower than the front segment 161 and as long as the distal end of the elastic tab 24 is only slightly displaced upwardly, the distal end of the elastic tab 24 can move beyond the step 1622, which does not require to displace the elastic tab 24 upwardly to a horizontal level or the same height with the front segment 161, therefore, the force required to apply can be reduced and operation is easier to perform.

The mating portion 22 of the each terminal 2 consists of a pair of elastic arms 25; the pair of elastic arms 25 extends forwardly from the base portion 21 in symmetry with each other, and cooperatively defines an insertion space 26. And the two elastic arms 25 each have a side wall 251, a bottom wall 252 and two protrusions 253 protruding toward the insertion space 26. The two side walls 251 are opposite to each other and spaced apart from each other and each are formed with a buffer section 2511 close to an end edge and an extension section 2512 between the buffer section 2511 and the base portion 21, the two side walls 251 each make a height of the buffer section 2511 lower than a height of the extension section 2512, the height of the buffer section 2511 is gradually increased from the end edge to the extension section 2512 so as to form a slope 2513. The bottom wall 252 and the side wall 251 of the each elastic arm 25 are perpendicularly connected, a penetrating groove 254 extending along the front to rear direction is formed between the side wall 251 and the bottom wall 252 and due to the penetrating groove 254, the bottom wall 252 and the side wall 251 of the terminal 2 are easily bent so as to be presented as perpendicular connection during formation of the terminal 2. A gap 255 extending rearwardly from the end edge is formed between the bottom walls 252 of the two elastic arms 25. The protrusions 253 of the each elastic arm 25 are formed on the side wall 251 and arranged along the front to rear direction and spaced apart from each other, where the protrusion 253 at the front is at least partially positioned in the buffer section 2511 and has a larger size and further protrudes toward the insertion space 26 than the protrusion 253 at the rear. The each elastic arm 25 further has a strengthening rib 256 formed on the extension section 2512 of the side wall 251 and the strengthening rib 256 is positioned behind the two protrusions 253 and extends along the front to rear direction strengthening the elastic arm 25 and allowing the elastic arm 25 to generate a larger positive force.

Referring to FIG. 1 through FIG. 5 and FIG. 11, the second electrical connector 200 comprises a second insulative housing 3 and a plurality of terminals 4. The second insulative housing 3 has a second base block 31 and a second latch unit 32, the second base block 31 defines a plurality of chambers 33 for respectively receiving the plurality of cylinders 12 of the first electrical connector 100 and a key receiving groove 34 communicating with two adjacent chambers 33 of the plurality of chambers 33 for receiving the key 13. The second latch unit 32 is connected to the second base block 31 and the second latch unit 32 and the second base block 31 cooperatively define a receiving space 35 for receiving the first latch unit 14. The second latch unit 32 comprises a second body 321 disposed on a top portion of the second base block 31, and the second body 321 is formed with a latching hole 322 cooperating with the latching block 143. The latching block 143 and the latching hole 322 are engaged with each other and when the latching block 143 is displaced downwardly, the engagement between the latching block 143 and the latching hole 322 is released. The receiving space 35 comprises a main space portion 351 between the second body 321 and the second base block 31 and two rib receiving grooves 352 respectively formed to the second base block 31 and communicating with the main space portion 351 and the two chambers 33 of the plurality of chambers 33. The main space portion 351 is used to receive the first body 142 and the two rib receiving grooves 352 are used to respectively receive the two engagement ribs 144.

The plurality of terminals 4 each are respectively fixed to the second insulative housing 3, and each have a mating portion 41 extending into the corresponding chamber 33 and a tail portion 42 extending out of the second insulative housing 3, the mating portion 41 mates with the mating portion 22 of the terminal 2 of the first electrical connector 100, the tail portion 42 is soldered on a circuit board (not shown).

The first electrical connector 100 and the second electrical connector 200 can only be mated when the key 13 of the first insulative housing 1 and the key receiving groove 34 of the second insulative housing 3 correspond to each other in position, therefore improper insertion may be prevented. In the embodiment, since both ends of the key 13 are respectively connected with the two cylinders 12 without an edge and corner of a free end, and the key 13 is supported by the two cylinders 12 the key 13 has more structural strength, and after repeatedly inserting, there is no risk that the function of preventing improper insertion will be lost due to the edge and corner of the free end being worn. Moreover, only when the engagement rib 144 and the rib receiving groove 352 correspond to each other, can the first electrical connector 100 and the second electrical connector 200 be mated further improving alignment between the connectors and preventing improper insertion.

Additionally, when the first insulative housing 1 and the second insulative housing 3 are mated with each other, the first latch unit 14 and the second latch unit 32 are engaged with each other, that is, the first body 142 and the two engagement ribs 144 are received in the receiving space 35 and the latching block 143 is inserted into the latching hole 322 so as to be limited to each other in position. That the engagement ribs 144 connect the first body 142 and the two cylinders 12 allowing the first body 142 to be supported more stablely, and in turn increase engagement strength and stability of the latch between the first latch unit 14 and the second latch unit 32.

Moreover, the mating portion 22 of the terminal 2 of the first electrical connector 100 is positioned in the cylinder 12 and when the first electrical connector 100 and the second electrical connector 200 are mated, the cylinder 12 extends into the corresponding chamber 33 allowing the mating portion 22 of the terminal 2 of the first electrical connector 100 to be mated with the mating portion 41 of the terminal 4 of the second electrical connector 200. Because the mating portion 22 of the terminal 2 consists of a pair of elastic arms 25, and the side wall 251 of the each elastic arm 25 makes the height of the buffer section 2511 lower than the height of the extension section 2512, a front end of the buffer section 2511 does not fully occupy the inner wall surface space in the cylinder 12. The cylinder 12 and the mating portion 22 cooperatively define an insertion port, that is an entrance for insertion of the mating portion 41 of the terminal 4 of the second electrical connector 200, because the space occupied by the mating portion 22 is reduced, there is a larger insertion space for insertion of the mating portion 41 of the terminal 4, so that the mating portion 41 of the terminal 4 is easily inserted into the insertion port.

Figure 8:
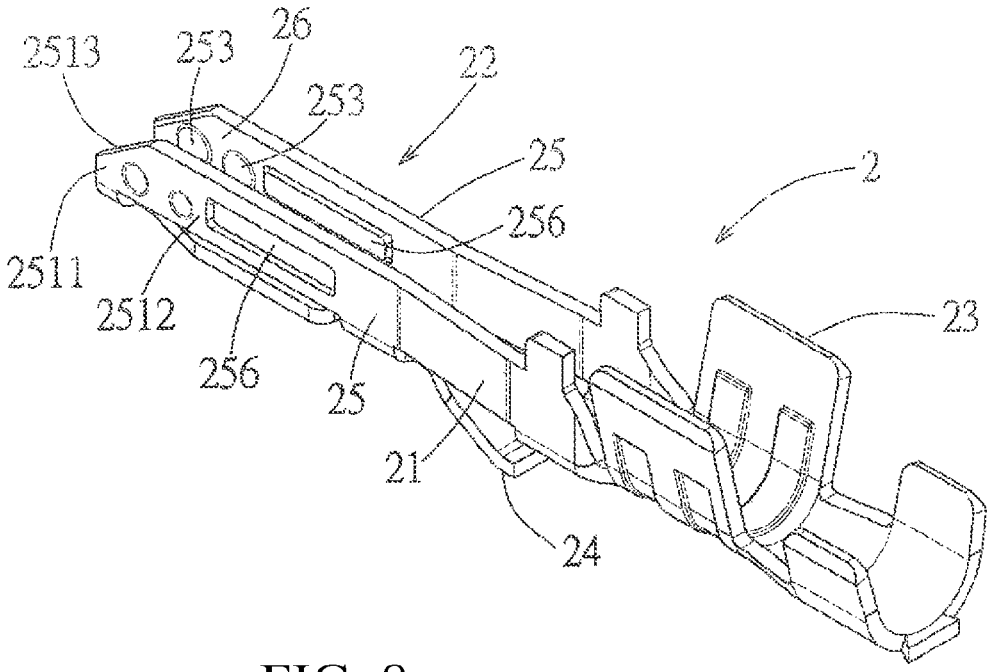
FIG. 8 is a perspective view illustrating the terminal of the first electrical connector of the embodiment.
Figure 9:
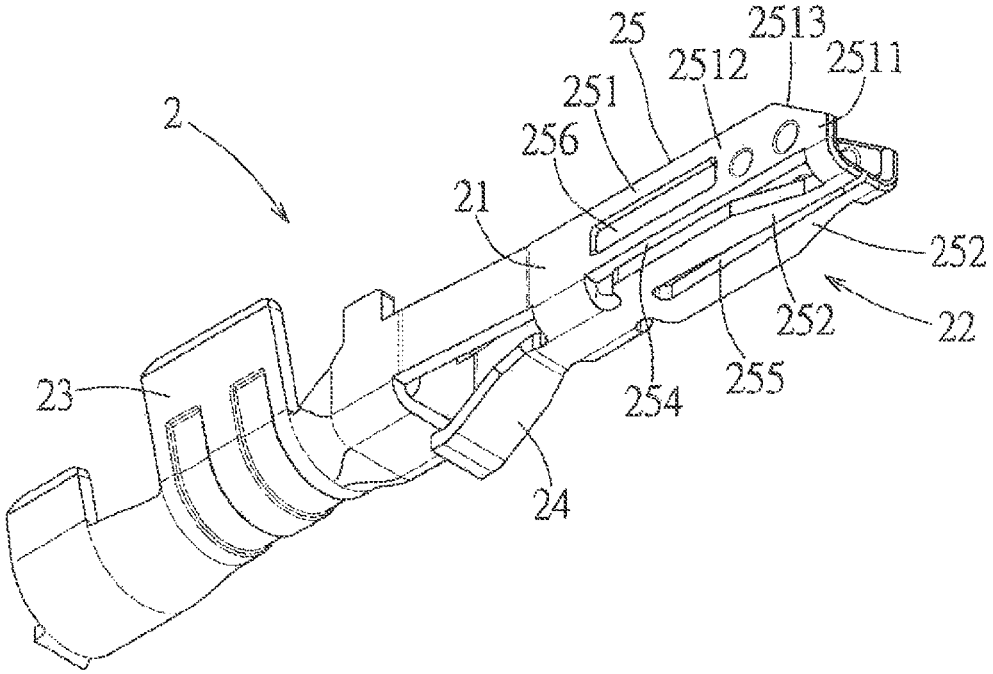
FIG. 9 is a view of FIG. 8 viewed from another angle.
Figure 10:
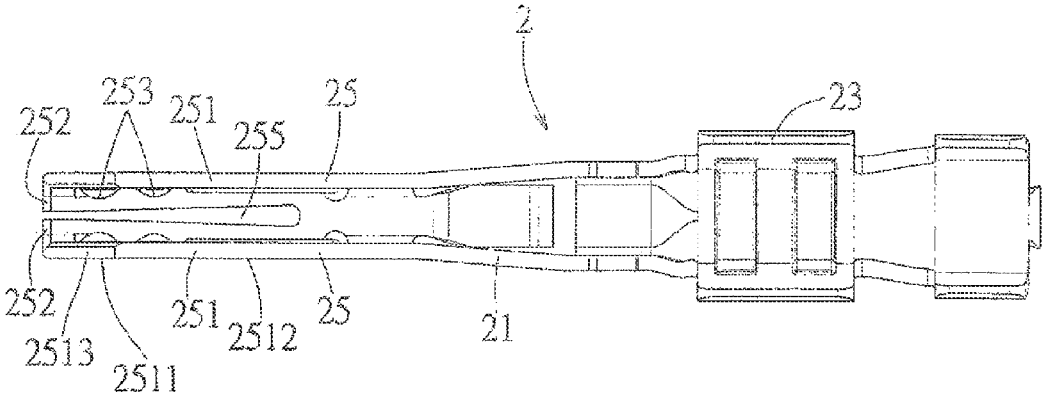
FIG. 10 is a top view illustrating the terminal of the first electrical connector of the embodiment.

Moreover, with the configuration of dual elastic arms 25, it is easier to push the two elastic arms 25 open, which may reduce a force applied for insertion of the terminal 4 to be mated. When the mating portion 41 of the terminal 4 is inserted between the two elastic arms 25, due to the protrusion 253 at the front being at least partially positioned in the buffer section 2511, the protrusion 253 at the front contacts the mating portion 41 of the terminal 4 earlier and because the protrusion 253 at the front has a larger size and further protrudes toward the insertion space 26 than the protrusion 253 at the rear, allows both the protrusion 253 at the front and the protrusion 253 at the rear to contact the mating portion 41 of the terminal 4 as shown in FIG. 8, increases the number of contact points between the terminal 2 and the terminal 4, and therefore assures stability of the electrical connection. Additionally, the elastic arm 25 is strengthened by the strengthening rib 256 allowing the elastic arm 25 to generate a larger positive force and increasing the stability of the electrical connection.

In conclusion, in the embodiment, since both ends of the key 13 of the first insulative housing 1 are respectively connected with the two cylinders 12 without an edge and corner of a free end, and the key 13 is supported by the two cylinders 12 the key 13 may have better structural strength, and after repeatedly inserting, there is no risk that the function of preventing improper insertion will be lost because the edge and corner of the free end is worn. Moreover, only when the engagement rib 144 and the rib receiving groove 352 also correspond to each other in position, can the first electrical connector 100 and the second electrical connector 200 be mated, which may further improving alignment and preventing the possibility of improper insertion. In addition, since the engagement ribs 144 connect the first body 142 and the two cylinders 12, this allows the first body 142 to be supported more stablely, and in turn increases the engagement strength and stability of the latch between the first latch unit 14 and the second latch unit 32.

In case there is a need to remove the terminal 2 of the first connector 100 t, the recess portion 1621 of the first insulative housing 1 is lower than the front segment 161, as long as the distal end of the elastic tab 24 is only slightly displaced upwardly, the distal end of the elastic tab 24 can be moved beyond the step 1622, which does not require the elastic tab 24 to be displaced upwardly to a horizontal level or the same height with the front segment 161, therefore, the force required to apply can be reduced and operation is easier to perform.

Moreover, with the mating portion 22 of the terminal 2 having a dual elastic arms 25 configuration, it is easier to push the two elastic arms 25 open, which reduces a force applied for insertion of the terminal 4 to be mated, and the side walls 251 of the each elastic arm 25 make the height of the buffer section 2511 lower than the height of the extension section 2512, the insertion port has a larger insertion space, so that the mating portion 41 of the terminal 4 is easily inserted into the insertion port. When the mating portion 41 of the terminal 4 is inserted between the two elastic arms 25, due to the protrusion 253 at the front at least partially positioned in the buffer section 2511, the protrusion 253 at the front contacts the mating portion 41 of the terminal 4 earlier, and since the protrusion 253 at the front has a larger size and the protrusion 253 at the front further protrudes toward the insertion space 26 than the protrusion 253 at the rear, allows both the protrusion 253 at the front and the protrusion 253 at the rear to contact the mating portion 41 of the terminal 4 and increasing the number of contact points between the terminal 2 and the terminal, and therefore assuring the stability of the electrical connection. Also, the elastic arm 25 is strengthened by the strengthening rib 256 allowing the elastic arm 25 to generate a larger positive force and increasing the stability of the electrical connection.

The above described are only the embodiments of the disclosure, which cannot limit the scope of the implementation of the disclosure, that is, simple equivalent variations and modifications made according to the scope of the Claims and the description content of the disclosure are still fallen within the scope of the disclosure.

I claim:

1. A terminal, comprising:

a base portion;

a mating portion consisting of a pair of elastic arms, the pair of elastic arms extending forwardly from the base portion in symmetry with each other and cooperatively defining an insertion space, the pair of elastic arms each having a side wall and two protrusions protruding toward the insertion space, the two side walls being opposite to each other and spaced apart from each other and each being formed with a buffer section close to an end edge with an extension section between the buffer section and the base portion, the two side walls each defining a height of the buffer section lower than a height of the extension section, the protrusions of the each elastic arm being formed on the side wall and arranged along a front to rear direction and spaced apart from each other, the protrusion at the front being at least partially positioned in the buffer section and having a larger size than the protrusion at the rear;

an engaging portion extending rearwardly from the base portion; and a fixed portion protruding from the base portion.

2. The terminal of claim 1, wherein the protrusion at the front further protrudes toward the insertion space than the protrusion at the rear.

3. The terminal of claim 1, wherein the each elastic arm further has a strengthening rib formed on the extension section of the side wall, the strengthening rib is positioned behind the two protrusions and extends along the front to rear direction.

4. The terminal of claim 1, wherein the side wall of the each elastic arm gradually increases the height of the buffer section from the end edge to the extension section forming a slope.

5. The terminal of claim 1, wherein each elastic arm further includes a bottom wall perpendicularly connected with the side wall, and a gap extending rearwardly from the end edge is formed between the bottom walls of the pair of elastic arms.

6. The terminal of claim 5, wherein a penetrating groove extending along the front to rear direction is formed between the side wall and the bottom wall of the each elastic arm.

7. The terminal of claim 1, wherein the fixed portion is an elastic tab extending rearwardly and obliquely downwardly from the base portion.

8. The terminal of claim 1, wherein the engaging portion is attached to an electrical conductive wire.

9. An electrical connector, comprising:

an insulative housing having a plurality of terminal receiving grooves which penetrate the insulative housing along a front to rear direction, a bottom side of the each terminal receiving groove being defined by a support wall, the support wall having a front segment close to the front, a rear segment close to the rear, and a middle segment between the front segment and the rear segment, the rear segment being formed with a recess portion extending along a front to rear direction and being formed with a step at a location where the recess portion is adjacent to the middle segment, the recess portion being lower than the front segment, the middle segment being formed with a recessed space between the front segment and the step, and the recessed space having an opening which is lower than the front segment and opens to the front; and a plurality of terminals respectively provided in the plurality of terminal receiving grooves and each having a base portion, a mating portion extending forwardly from the base portion, an engaging portion extending rearwardly from the base portion, and an elastic tab extending rearwardly from the base portion, the mating portion and the engaging portion being positioned respectively to two positions of the corresponding terminal receiving groove which are respectively adjacent to the front segment and the rear segment, the elastic tab extending into the recessed space from a rear end of the front segment and a distal end of the elastic tab facing the step so as to be stopped by the step and be prevented from moving rearwardly, and the elastic tab being capable of being elastically displaced to move beyond the step so as to move rearwardly.

10. The electrical connector of claim 9, wherein at least a part of the base portion of the each terminal is positioned at a location in the corresponding terminal receiving groove which is adjacent to the front segment.

11. The electrical connector of claim 9, wherein a rear end of the each front segment is formed with a supporting slope for abutting the corresponding elastic tab.

12. The electrical connector of claim 11, wherein each support wall further includes a front stopping portion protruding from the front segment close to a front end of the support wall to stop the mating portion of the corresponding terminal from moving forwardly.

13. The electrical connector of claim 9, wherein a height of the step is lower than a height of the front segment.

14. The electrical connector of claim 9, wherein the elastic tab extends rearwardly and obliquely downwardly from the base portion.

15. An electrical connection device, comprising:

a first electrical connector comprising a first insulative housing, the first insulative housing having a first base block, a plurality of cylinders, a key and a first latch unit, the plurality of cylinders extending from the first base block in an array arrangement, and the plurality of cylinders and the first base block cooperatively defining a plurality of terminal receiving grooves which respectively extend from the plurality of cylinders to the first base block and penetrate the plurality of cylinders and the first base block along a front to rear direction, the key being connected between two adjacent cylinders of the plurality of cylinders, the first latch unit being connected to the first base block and extending toward the same side along with the plurality of cylinders;

a second electrical connector comprising a second insulative housing, the second insulative housing having a second base block and a second latch unit, the second base block defining a plurality of chambers for respectively receiving the plurality of cylinders and a key receiving groove communicating with two adjacent chambers of the plurality of chambers for receiving the key, the second latch unit being connected to the second base block so that the second latch unit and the first latch unit are engaged with each other when the first electrical connector and the second electrical connector are mated.

16. The electrical connection device of claim 15, wherein the first latch unit is further connected with at least a cylinder.

17. The electrical connection device of claim 15, wherein the second latch unit and the second base block cooperatively define a receiving space receiving the first latch unit.

18. The electrical connection device of claim 15, wherein the first latch unit comprises a first body provided on a top portion of the first base block, a latching block provided on the first body, and two engagement ribs respectively connecting the first body and the two cylinders of the plurality of cylinders;

the second latch unit and the second base block cooperatively define a receiving space receiving the first latch unit;

the second latch unit comprises a second body provided on a top portion of the second base block, and the second body is formed with a latching hole cooperated with the latching block;

the receiving space comprises a main space portion between the second body and the second base block and two rib receiving grooves respectively formed to the second base block and communicating with the main space portion and the two chambers of the plurality of chambers, the main space portion is used to receive the first body and the two rib receiving grooves are used to respectively receive the two engagement ribs.

19. The electrical connection device of claim 18, wherein the first body extends from the first base block toward a side where the plurality of cylinders are formed and then is bent and extends reversely above the first base block so as to form a free end, the latching block is disposed between a bent portion and the free end of the first body and extends upwardly.

20. The electrical connection device of claim 19, wherein the first latch unit further comprises a pair of limit portions provided on a top surface of the first base block, both sides of the free end of the first body are respectively limited by the pair of limit portions.

* * * * *